US008517332B2

(12) United States Patent
Liu

(10) Patent No.: US 8,517,332 B2
(45) Date of Patent: Aug. 27, 2013

(54) CLAMP MECHANISM FOR CLAMPING A HEAT SINK

(75) Inventor: Peng Liu, New Taipei (TW)

(73) Assignee: Wistron Corporation, Xizhi Dist., New Taipei (TW)

( * ) Notice: Subject to any disclaimer, the term of this patent is extended or adjusted under 35 U.S.C. 154(b) by 157 days.

(21) Appl. No.: 13/189,591

(22) Filed: Jul. 25, 2011

(65) Prior Publication Data

US 2012/0280102 A1 Nov. 8, 2012

(30) Foreign Application Priority Data

May 5, 2011 (CN) ..... 2011 1 0115315

(51) Int. Cl.
*A47B 97/00* (2006.01)

(52) U.S. Cl.
USPC ..... 248/500; 248/505; 361/702; 361/704

(58) Field of Classification Search
USPC ..... 81/300, 302, 420; 29/278; 361/702, 361/704; 248/316.5, 505, 500
See application file for complete search history.

(56) References Cited

U.S. PATENT DOCUMENTS 4,756,078 A * 7/1988 Dougherty et al. ..... 29/764
4,873,761 A * 10/1989 Korsunsky et al. ..... 29/741
5,304,735 A * 4/1994 Earl et al. ..... 174/16.3
6,023,832 A * 2/2000 Boe ..... 29/426.6
6,029,330 A * 2/2000 Ratia, Jr. ..... 29/235
6,450,248 B1 * 9/2002 Chang ..... 165/80.3
6,473,306 B2 * 10/2002 Koseki et al. ..... 361/704
6,501,657 B1 * 12/2002 Carr ..... 361/704
6,542,367 B2 * 4/2003 Shia et al. ..... 361/703
6,640,884 B1 * 11/2003 Liu ..... 165/80.3
6,822,864 B2 * 11/2004 Huang et al. ..... 361/697
6,822,870 B2 * 11/2004 Hong et al. ..... 361/704
6,978,827 B2 * 12/2005 Armstrong ..... 165/80.3
7,042,728 B2 * 5/2006 Hu ..... 361/704
7,133,288 B2 * 11/2006 DelPrete et al. ..... 361/719
7,327,575 B2 * 2/2008 Yu et al. ..... 361/719
7,333,333 B2 * 2/2008 Zhao et al. ..... 361/700
7,362,581 B2 * 4/2008 Chen ..... 361/709
7,558,067 B2 * 7/2009 Lin ..... 361/710
7,672,133 B2 * 3/2010 Lin ..... 361/704
2002/0181204 A1 * 12/2002 Shia et al. ..... 361/704
2002/0181205 A1 * 12/2002 Shia et al. ..... 361/704
2010/0024610 A1 2/2010 Chen

* cited by examiner

*Primary Examiner* — Nkeisha Smith
(74) *Attorney, Agent, or Firm* — Winston Hsu; Scott Margo

(57) ABSTRACT

A clamp mechanism for clamping a heat sink is disclosed in the present invention. The clamp mechanism includes a base. An accommodating space is formed on a side of the base, and the accommodating space is for accommodating the heat sink. The clamp mechanism further includes at least one constraining component pivoted to the base for engaging with an engaging portion of the heat sink, so as to fix the heat sink inside the accommodating space. The clamp mechanism further includes at least one contacting component pivoted to the base for buckling a hook of the heat sink when pivoting relative to the base, so as to rotate the hook relative to a shaft of the heat sink.

12 Claims, 6 Drawing Sheets

CLAMP MECHANISM FOR CLAMPING A HEAT SINK

BACKGROUND OF THE INVENTION

1. Field of the Invention

The present invention relates to a clamp mechanism for clamping a heat sink, and more particularly, to a clamp mechanism with small volume and easy operation.

2. Description of the Prior Art

A clamp mechanism can be used for installing a heat sink on a circuit board, so as to achieve rapid assembly. A conventional clamp mechanism is utilized to clamp the heat sink by a grabber, and the conventional clamp mechanism further includes a handle for pushing a hook of the heat sink, so as to engage the hook on an engaging portion of the circuit board, and to fix the heat sink on the circuit board. However, the conventional clamp mechanism is heavy and huge, and the hook of the heat sink is hard to rotate, so the conventional clamp mechanism has drawback of difficult operation and low operating efficiency.

SUMMARY OF THE INVENTION

The present invention provides a clamp mechanism with small volume and easy operation for solving above drawbacks.

According to the claimed invention, the clamp mechanism includes a base. An accommodating space is formed on a side of the base, and the accommodating space is for accommodating the heat sink. The clamp mechanism further includes at least one constraining component pivoted to the base for engaging with an engaging portion of the heat sink, so as to fix the heat sink inside the accommodating space. The clamp mechanism further includes at least one contacting component pivoted to the base for buckling a hook of the heat sink when pivoting relative to the base, so as to rotate the hook relative to a shaft of the heat sink.

According to the claimed invention, a slot is formed on a first end of the contacting component for engaging with the hook, so that the first end of the contacting component slides relative to the hook.

According to the claimed invention, the clamp mechanism further comprises a pivoting pin, the contacting component pivots to the base via the pivoting pin, and a distance between the pivoting pin and the first end of the contacting component is substantially smaller than a distance between the pivoting pin and a second end of the contacting component opposite to the first end.

According to the claimed invention, the clamp mechanism further includes a resilient component, two ends of the resilient component being respectively connected to the base and the contacting component, the resilient component being for providing a resilient recovering force to the contacting component, so as to pivot the contacting component relative to the base.

According to the claimed invention, the resilient component is for moving the contacting component away from the hook.

According to the claimed invention, the clamp mechanism further includes a restraining component disposed between the base and the constraining component for holding the constraining component to engage with the engaging portion of the heat sink.

According to the claimed invention, the clamp mechanism further includes a positioning plate disposed between the base and the resilient component for preventing the heat sink from separating from the accommodating space.

According to the claimed invention, the clamp mechanism further includes an auxiliary component pivoted to the base and located by a side of the contacting component, the contacting component rotating the hook relative to the shaft of the heat sink when the auxiliary component and the contacting component pivot toward each other.

According to the claimed invention, a guiding slot is formed on the base, the clamp mechanism further comprises a guiding pin, an end of the guiding pin pierces through the constraining component, and the other end of the guiding pin slides along the guiding slot.

According to the claimed invention, the clamp mechanism further includes a block disposed on the base and adjacent to the constraining component for limiting a pivot movement of the constraining component relative to the base.

According to the claimed invention, a positioning slot is further formed on the base for positioning the heat sink inside the accommodating space.

According to the claimed invention, the clamp mechanism further includes a handle connected to the auxiliary component or the contacting component.

The clamp mechanism of the present invention pivots the contacting component relative to the base for moving the hook of the heat sink downwardly. Because the moment arm on the forcing end of the contacting component is greater than the moment arm on the stressed end of the contacting component, the contacting component can be operated for pressing the hook conveniently and easily, so that the clamp mechanism of the present invention has advantages of quick operation and enhanced operating efficiency.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
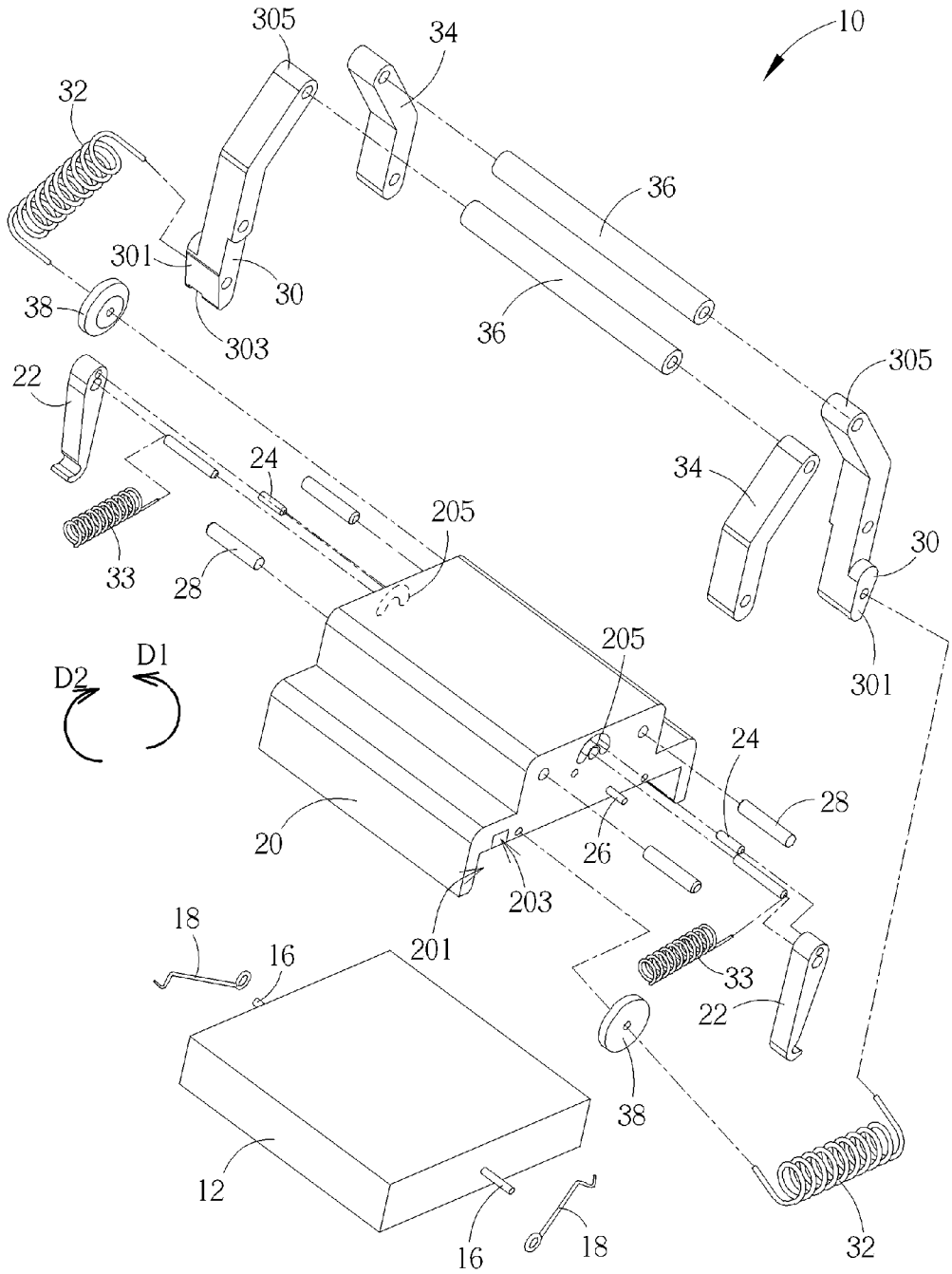
FIG. 1 is an exploded diagram of a clamp mechanism according to an embodiment of the present invention.
Figure 2:
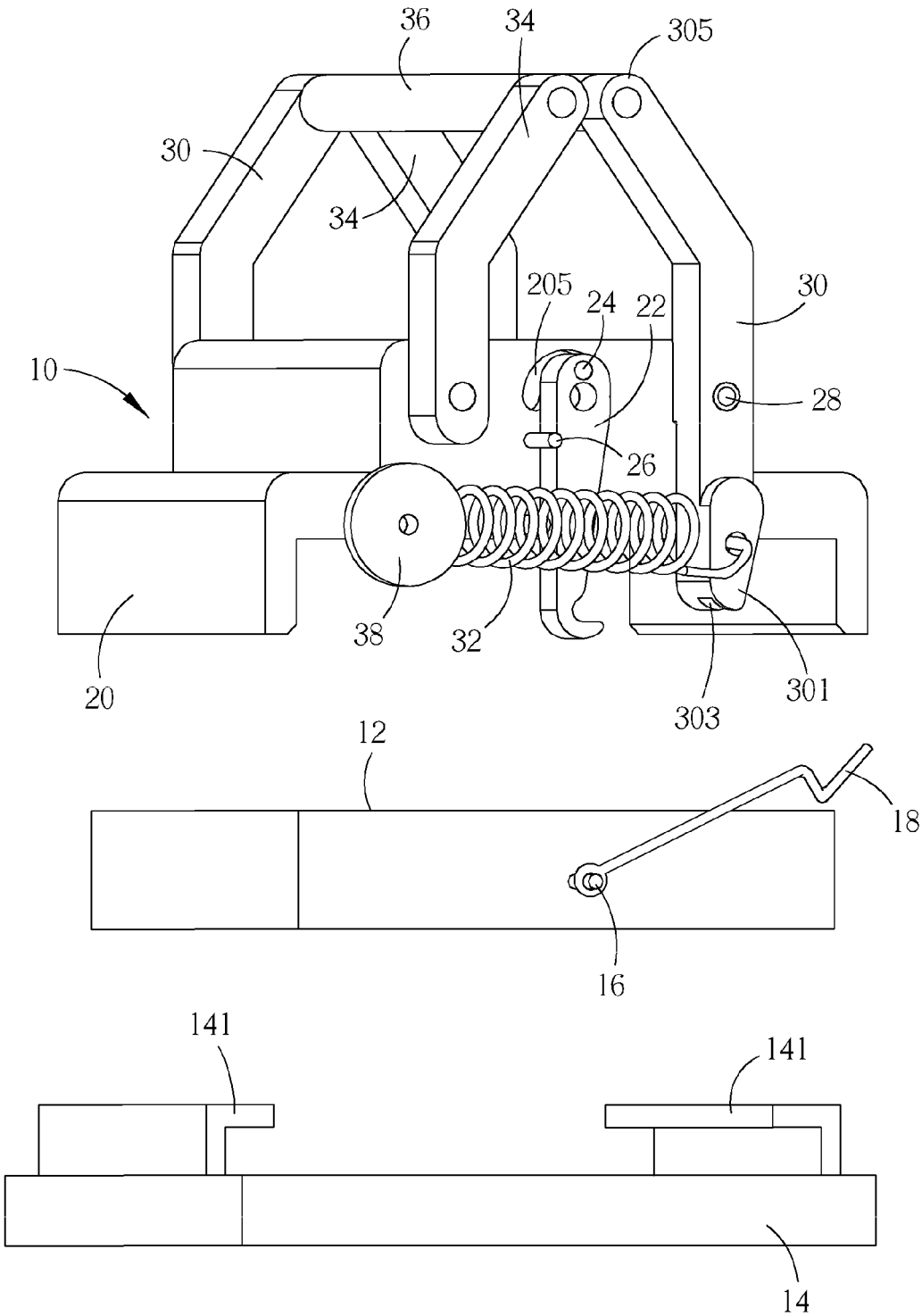
FIG. 2 is an assembly diagram of the clamp mechanism, a heat sink and a circuit board according to the embodiment of the present invention.

Please refer to FIG. 1 and FIG. 2. FIG. 1 is an exploded diagram of a clamp mechanism 10 according to an embodiment of the present invention. The clamp mechanism 10 is for installing a heat sink 12 on a circuit board 14. FIG. 2 is an assembly diagram of the clamp mechanism 10, the heat sink 12 and the circuit board 14 according to the embodiment of the present invention. The heat sink 12 includes a shaft 16, and two hooks 18 pivoted to two ends of the shaft 16. The hook 18 can be a resilient hook. The clamp mechanism 10 can be for pressing the two hooks 18 when clamping the heat sink 12, and further for releasing the two hooks 18 after the heat sink 12 is set on the circuit board 14, so that the two hooks 18 can be engaged with two engaging sets 141 of the circuit board 14 by a resilient recovering force of the two hooks 18.

As shown in FIG. 1 and FIG. 2, the clamp mechanism 10 includes a base 20, and an accommodating space 201 is formed on a side of the base 20 for accommodating the heat sink 12. A positioning slot 203 can be further formed on the base 20 for accommodating the heat sink 12 into the accommodating space 201 accurately. The clam mechanism 10 further includes two constraining components 22 respectively pivoted to two sides of the base 20. As the heat sink 12 is accommodated inside the accommodating space 201, each constraining component 22 is for engaging with an engaging portion of the heat sink 12, so as to constrain the heat sink 12 inside the accommodating space 201. In this embodiment, the engaging portion of the heat sink 12 can be the shaft 16, which means the constraining component 22 of the clamp mechanism 10 can be for engaging with the shaft 16 of the heat sink 12, so as to fix the heat sink 12 inside the accommodating space 201.

In addition, two guiding slots 205 can be respectively formed on two surfaces of the base 20, and each guiding slot 205 can be an arc slot. The clamp mechanism 10 can further include two guiding pins 24. An end of the guiding pin 24 can pierce through the corresponding constraining component 22, and the other end of the guiding pin 24 can slide along the corresponding guiding slot 205 for constraining a pivoting direction and movement of the constraining component 22 relative to the base 20. The clamp mechanism 10 can further include two blocks 26. Each block 26 is disposed on the base 20 and located at a position adjacent to the corresponding constraining component 22. The block 26 can be for constraining the pivoting movement of the constraining component 22 relative to the base 20.

The clamp mechanism 10 further includes two pivoting pins 28, and two contacting components 30 respectively pivoted to two sides of the base 20 via the corresponding pivoting pin 28. When the contacting component 30 pivots relative to the base 20 in a first direction D1 (the counterclockwise direction), the contacting component 30 buckles the hook 18 of the heat sink 12 and simultaneously presses the hook 18 to rotate relative to the shaft 16 in a second direction D2 (the clockwise direction) opposite to the first direction D1. For increasing operating accuracy of the clamp mechanism 10, a slot 303 can be formed on a first end 301 of each contacting component 30. The slot 303 can engage with the hook 18, so that the first end 301 of the contacting component 30 can stably slide relative to the hook 18 along an axial direction of the hook 18 for pressing.

In addition, the clamp mechanism 10 can further include two resilient components 32. Two ends of each resilient component 32 are respectively connected to the base 20 and the corresponding contacting component 30. The resilient component 32 can provide a resilient recovering force to the contacting component 30, so as to pivot the contacting component 30 relative to the base 20 in a direction opposite to the second direction D2 for separating the first end 301 of the contacting component 30 from the hook 18. The clamp mechanism 10 can further include two restraining components 33 respectively disposed between the base 20 and the corresponding constraining components 22. Each restraining component 33 is for stably engaging the constraining component 22 with the engaging portion of the heat sink 12 when the contacting component 30 is pushed for stretching the resilient component 32. Generally, the restraining component 33 can be a spring, and the spring can restrain the constraining component 22 to engage the heat sink 12 by stretching or compressing.

Besides, the clamp mechanism 10 can further include two auxiliary components 34. Each auxiliary component 34 pivots to the base 20 and is located by a side of the corresponding contacting component 30. The contacting component 30 can rotate the hook 18 relative to the shaft 16 of the heat sink 12 when the auxiliary component 34 and the contacting component 30 pivots to each other, which means that the auxiliary component 34 can be a component for applying force on the contacting component 30 easily. The clamp mechanism 10 can further include two handles 36. Two ends of each handle 36 can be respectively connected to the contacting component 30 and the corresponding auxiliary component 34 disposed on the two sides of the base 20. The handle 36 can be a point of application when forcing on the auxiliary component 34 and the contacting component 30. The clamp mechanism 10 can further include two positioning plates 38 respectively disposed between the base 20 and the corresponding resilient component 32. The two positioning plates 38 contact against the heat sink 12 at two sides of the accommodating space 203, so as to prevent the heat sink 12 from separating from the accommodating space 203.

Figure 3:
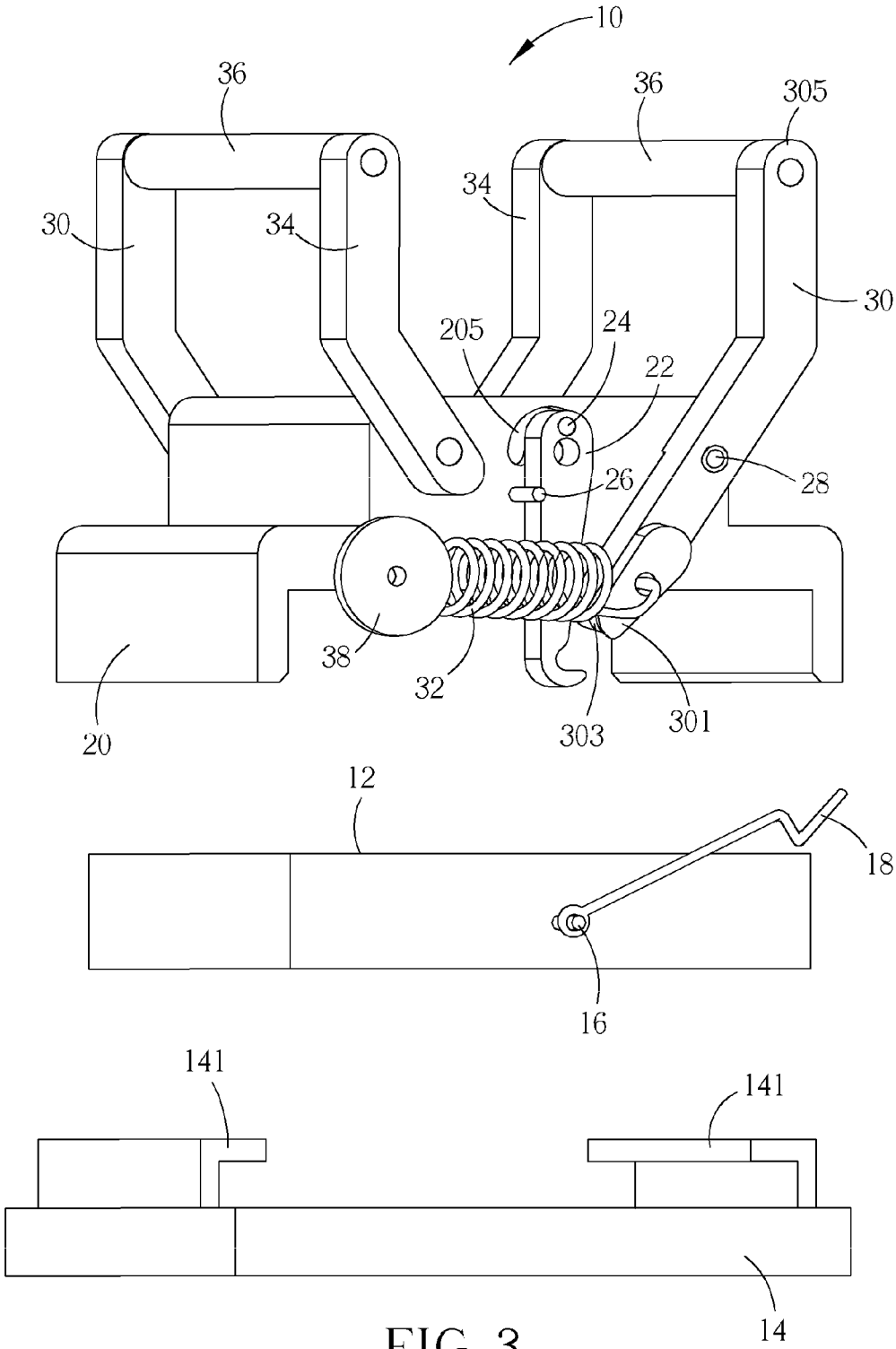
FIG. 3 to FIG. 6 are diagrams of the clamp mechanism in different operating modes according to the embodiment of the present invention.
Figure 4:
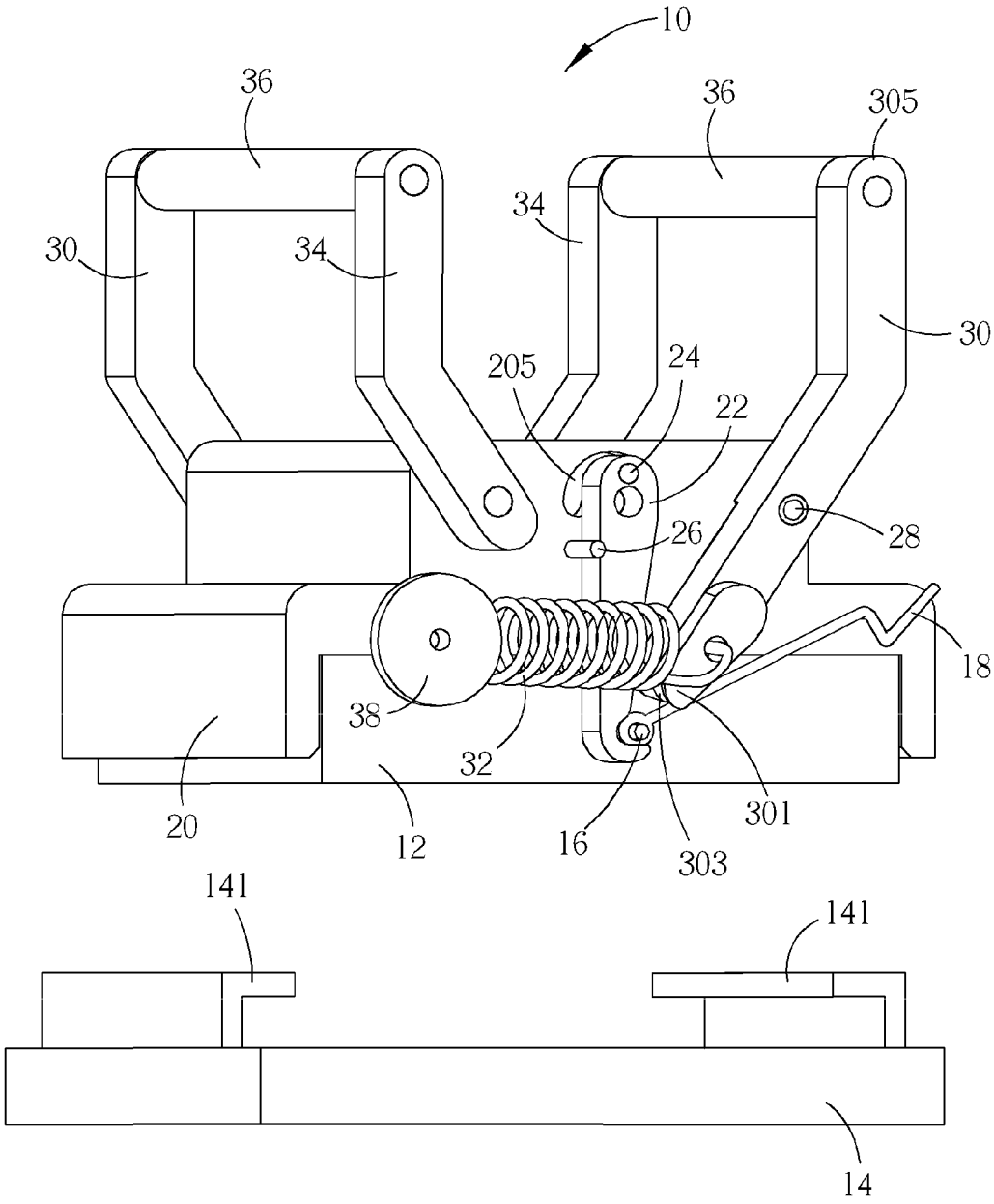
Figure 5:
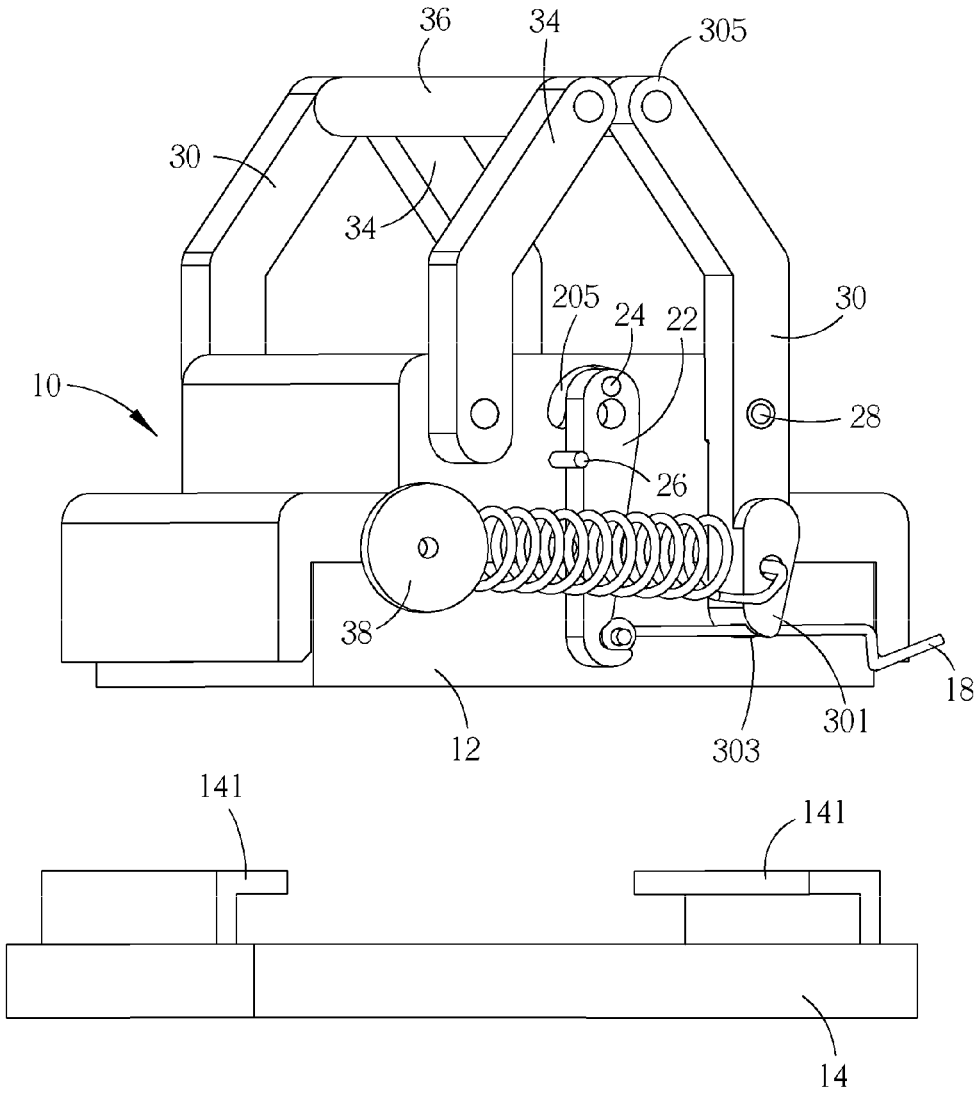

Please refer to FIG. 3 to FIG. 6. FIG. 3 to FIG. 6 are diagrams of the clamp mechanism 10 in different operating modes according to the embodiment of the present invention. As shown in FIG. 3, the hook 18 of the heat sink 12 is located at an initial position higher than a horizontal plane when having not been pressed. As shown in FIG. 4, the heat sink 12 is accommodated inside the accommodating space 201 by the positioning slot 203, and then the constraining component 22 of the clamp mechanism 10 is engaged with the shaft 16 of the heat sink 12 for preventing the heat sink 12 from separating from the accommodating space 201. As shown in FIG. 5, each slot 303 on the contacting component 30 can be engaged with the hook 18 when the handle 36 is pushed for pivoting the auxiliary component 34 and the contacting component 30 to each other. As the contacting component 30 rotates in the first direction D1, the first end 301 of the contacting component 30 can rotate the hook 18 relative to the shaft 16 in the second direction D2 gradually, so that the hook 18 can rotate from the initial position to the other position closing to the horizontal plane. It should be mentioned that a distance between the pivoting pin 28 and the first end 301 of the contacting component 30 can be substantially smaller than a distance between the pivoting pin 28 and a second end 305 of the contacting component 30 opposite to the first end 301, which means that a moment arm of the first end 301 (a forcing end) of the contacting component 30 is greater than a moment arm of the second end 305 (a stressed end), so the clamp mechanism 10 can be utilized for pivoting the auxiliary component 34 and the contacting component 30 to each other easily, and for rotating the hook 18 relative to the shaft 16.

Figure 6:
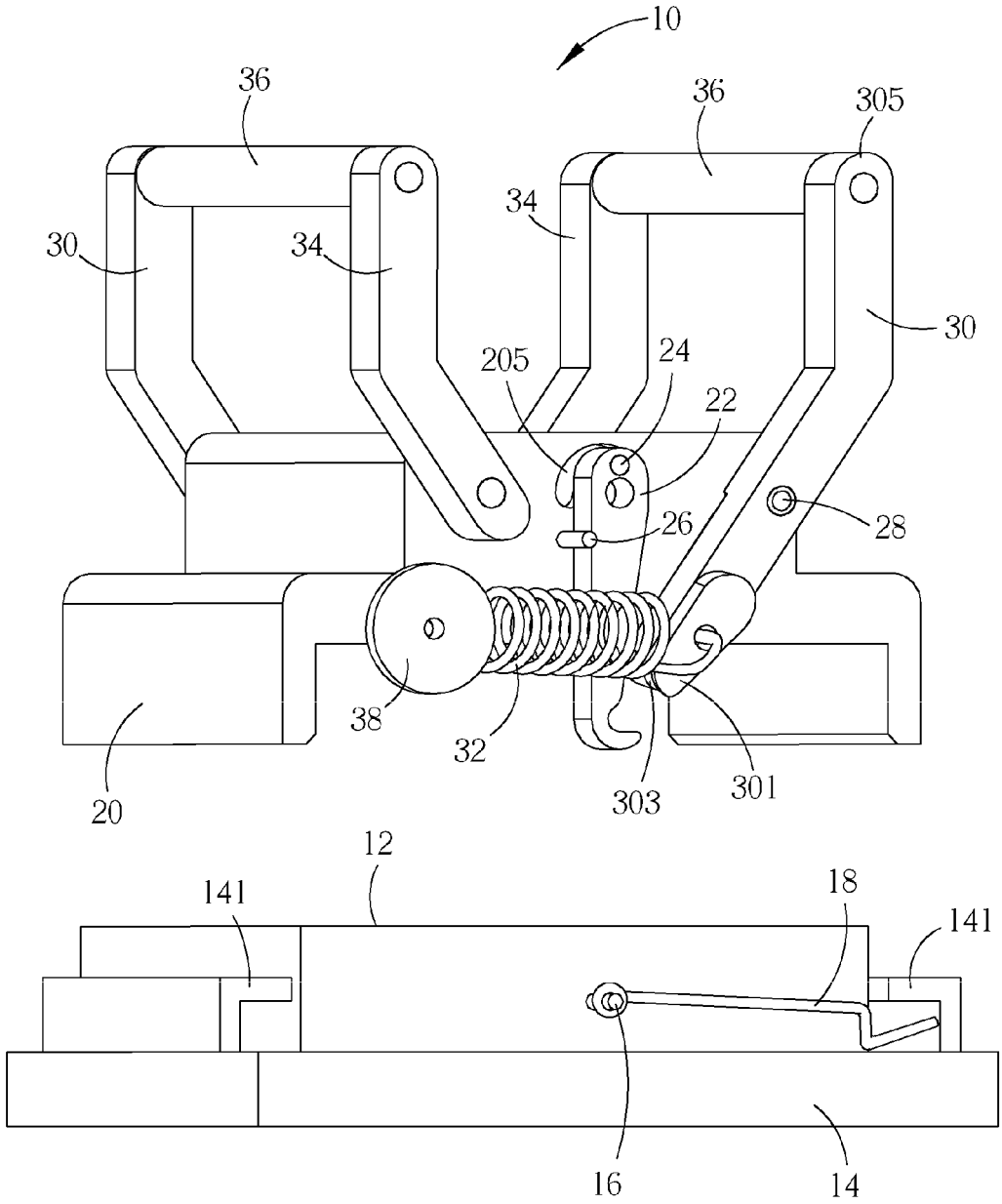

Finally, as shown in FIG. 6, the contacting component 30 can pivot relative to the base 20 in the second direction D2 by the resilient recovering force of the resilient component 32 after the heat sink 12 is set on the circuit board 14 and the auxiliary component 34 and the contacting component 30 are not applied on force, and which results the contacting component 30 and the auxiliary component 34 pivot to each other for separating the first end 301 of the contacting component 30 from the hook 18. When the hook 18 is not pressed by the contacting component 30, the hook 18 can move upward for engaging with the engaging sets 141 of the circuit board 14 by the recovering force, such as the resilient recovering force provided from a trosional spring disposed on the shaft 16, so as to install the heat sink 12 on the circuit board 14 stably.

Comparing to the prior art, the clamp mechanism of the present invention pivots the contacting component relative to the base for moving the hook of the heat sink downwardly. Because the moment arm on the forcing end of the contacting component is greater than the moment arm on the stressed end of the contacting component, the contacting component can be operated for pressing the hook conveniently and easily, so that the clamp mechanism of the present invention has advantages of quick operation and enhanced operating efficiency.

Those skilled in the art will readily observe that numerous modifications and alterations of the device and method may be made while retaining the teachings of the invention.

What is claimed is:

1. A clamp mechanism comprising:

a base, an accommodating space being formed on a side of the base for accommodating a heat sink;

at least one constraining component pivoted to the base for engaging with an engaging portion of the heat sink so as to fix the heat sink inside the accommodating space;

at least one contacting component pivoted to the base for buckling a hook of the heat sink when pivoting relative to the base so as to rotate the hook relative to a shaft of the heat sink; and an auxiliary component connected to the base and located by a side of the contacting component, one end of the contacting component moving away from the auxiliary component so as to rotate the hook relative to the shaft of the heat sink when the other end of the contacting component moves toward the auxiliary component.

2. The clamp mechanism of claim 1, wherein a slot is formed on a first end of the contacting component for engaging with the hook, so that the first end of the contacting component slides relative to the hook.

3. The clamp mechanism of claim 1, wherein the clamp mechanism further comprises a pivoting pin, the contacting component pivots to the base via the pivoting pin, and a distance between the pivoting pin and the first end of the contacting component is substantially smaller than a distance between the pivoting pin and a second end of the contacting component opposite to the first end.

4. The clamp mechanism of claim 1, further comprising:

a resilient component, two ends of the resilient component being respectively connected to the base and the contacting component, the resilient component being for providing a resilient recovering force to the contacting component, so as to pivot the contacting component relative to the base.

5. The clamp mechanism of claim 4, wherein the resilient component is for moving the contacting component away from the hook.

6. The clamp mechanism of claim 4, further comprising:

a restraining component disposed between the base and the constraining component for holding the constraining component to engage with the engaging portion of the heat sink.

7. The clamp mechanism of claim 4, further comprising:

a positioning plate disposed between the base and the resilient component for preventing the heat sink from separating from the accommodating space.

8. The clamp mechanism of claim 1, wherein the auxiliary component is pivoted to the base, and the contacting component rotates the hook relative to the shaft of the heat sink when the auxiliary component and the contacting component pivot toward each other.

9. The clamp mechanism of claim 8, further comprising:

a handle connected to the auxiliary component.

10. The clamp mechanism of claim 1, wherein a guiding slot is formed on the base, the clamp mechanism further comprises a guiding pin, an end of the guiding pin pierces through the constraining component, and the other end of the guiding pin slides along the guiding slot.

11. The clamp mechanism of claim 1, further comprising:

a block disposed on the base and adjacent to the constraining component for limiting a pivot movement of the constraining component relative to the base.

12. The clamp mechanism of claim 1, further comprising:

a handle connected to the contacting component.

* * * * *